US006113716A

United States Patent [19]

Schramayr et al.

[11] Patent Number: 6,113,716

[45] Date of Patent: Sep. 5, 2000

[54] METHOD AND APPARATUS FOR SEALING AN EDGE REGION OF A PLANAR MATERIAL PLY

[75] Inventors: Ernst Schramayr, Barneveld; Robert J. Beasock, Clark Mills; John R. Russo, Marcy, all of N.Y.

[73] Assignee: Jet Sew Technologies, Inc., Barneveld, N.Y.

[21] Appl. No.: 09/156,763

[22] Filed: Sep. 18, 1998

[51] Int. Cl.[7] ..... B32B 31/26; B65C 69/00

[52] U.S. Cl. ..... 156/64; 156/285; 156/351; 156/367; 156/572

[58] Field of Search ..... 156/497, 64, 351, 156/356, 362, 285, 571, 367, 357, 556, 572, 569, 570, 359, 378; 198/867.02; 271/247, 82, 226, 249, 85, 10.01, 267, 14, 10.14

[56] References Cited

U.S. PATENT DOCUMENTS

| | | | |
|---|---|---|---|
| 4,601,249 | 7/1986 | Frye | 112/121.14 |
| 4,685,408 | 8/1987 | Frye | 112/262.3 |
| 4,888,229 | 12/1989 | Paley et al. | 428/192 |
| 5,018,462 | 5/1991 | Brocklehurst | 112/121.12 |
| 5,069,735 | 12/1991 | Reynolds | 156/497 |
| 5,466,326 | 11/1995 | Cherney | 156/359 |
| 5,605,731 | 2/1997 | Pubill | 428/43 |
| 5,619,942 | 4/1997 | Stewart et al. | 112/470.07 |
| 5,645,002 | 7/1997 | Brocklehurst | 112/470.07 |
| 5,769,999 | 6/1998 | Anderson et al. | 156/359 |
| 5,928,462 | 7/1999 | Stewart et al. | 156/359 |
| 5,967,505 | 10/1999 | Lin et al. | 271/4.01 |

*Primary Examiner*—Richard Crispino
*Assistant Examiner*—George R. Koch, III

[57] ABSTRACT

An automated apparatus and method for sealing an edge region of a planar material ply includes a central controller and at least one platform. The automated apparatus and method further employs a mechanism for picking a single planar material ply in addition to a mechanism for moving the single planar material ply to the platform. The automated apparatus and method includes a sealing device which seals the edge region of the planar material ply where the sealing device provides a fluid to a predetermined focused region within the edge region. The fluid substantially shrinks and melts strands in the focused region of the planar material ply.

34 Claims, 9 Drawing Sheets

METHOD AND APPARATUS FOR SEALING AN EDGE REGION OF A PLANAR MATERIAL PLY

BACKGROUND OF THE INVENTION

1. Field of the Invention

The present invention relates to a method and apparatus for sealing an edge region of a planar material ply. The method and apparatus employ an automated system which includes a central controller, planar material ply detectors, planar material ply stack detectors, movable platforms, a picking station device, and a sealing device which substantially shrinks and melts strands in an edge region of a planar material ply. The picking station device orients the single planar material ply in a predetermined direction on a platform and in a substantially smooth manner so that a predetermined focused region within the edge region of the planar material ply can be applied with a fluid at a predetermined temperature.

2. Description of the Background Art

Conventional sealing devices employ hand-held hot air guns which require an operator to move a hot air gun up and down a stack of planar material plies. The stacks of planar material plies often include quantities of fifty or more planar material plies. This manual operation of moving a hand-held hot air gun often results with inconsistent sealing of the planar material plies and frequently causes many of the planar material plies to be burned due to an inadequate distance between the hot air gun and planar material plies. In addition, this sealing method requires an inordinate amount of manual labor in sealing each of the individual wash cloths through the movement of the hand-held hot air gun.

Various conventional air heating devices currently exist. These conventional air heating devices can also be used in large manufacturing processes where edge regions of planar material plies are sealed prior to the formation of the planar sheets. For example, in U.S. Pat. No. 5,069,735 (Reynolds), a jet is employed in an automated process where heated air is directed towards a warp direction of long rolls of planar material which are later cut to form planar material plies. The jet device of the Reynolds patent requires continuous operation of the heating element where air is continuously fed through the jet device with an outlet pressure of about 10 p.s.i. The heating element of the Reynolds patent which heats the air that flows through the jet device is incapable of providing intermittent heat and will burn out if it is cycled on and off if the device is used in the processing of individual planar material plies.

Accordingly, a need in the art exists for an automated sealing apparatus and method which can seal edge regions of single planar material plies in addition to providing a heating element which can be cycled on and off in order to conserve energy when the planar material plies are individually loaded beneath the heating device in a sealing process. A need in the art also exists for an automated sealing apparatus and method which reduces the amount of manual labor in sealing single planar material plies.

SUMMARY OF THE INVENTION

Accordingly, it is primary object of the present invention to provide an automated sealing apparatus and method which seals an edge region of planar material plies where the sealing device provides a fluid which substantially shrinks and melts strands in a focused region in the edge region of the planar material ply.

It is a further object of the present invention to provide an automated sealing apparatus and method capable of handling multiple planar material plies and stacking the sealed planar material plies where the automated sealing apparatus and method can continuously run without an operators constant supervision.

Another object of the present invention is to provide an automated sealing apparatus and method which closely parallels the manual sealing of planar materials but permits the continuous movement of the single planar material plies.

It is a further object of the present invention to provide an automated sealing apparatus and method which seals single planar material plies in a rapid manner with fewer errors and inconsistencies which in turn increases the overall quality control of the planar material plies.

Another object of the present invention is to significantly reduce the amount of operator time required in the sealing of the planar material plies.

It is a further object of the present invention to provide an automated sealing apparatus and method which includes a sealing device that can be cycled on and off at predetermined times in accordance with the loading and unloading of planar material plies.

It is an additional object of the present invention to provide an automated sealing apparatus and method which employs a heating device which can be cycled on and off during predetermined times in accordance with the loading and unloading of planar material plies.

Another object of the present invention is to provide an automated sealing apparatus and method which counts the number of planar material plies that are processed in addition to forming stacks of planar material plies of a predetermined number which are offset relative to each other. This offsetting of stacks of planar material plies facilitates ease of separation between respective stacks of planar material plies that have a predetermined number of planar material plies.

A further object of the present invention is to provide an automated sealing apparatus and method which compresses stacks of planar material plies as single planar material plies are loaded on a respective stack in order facilitate reduction of storage space for respective stacks of planar material plies.

It is another object of the present invention to provide an automated sealing apparatus and method which unloads a predetermined number of stacks of planar material plies onto a platform outside of an elevator arrangement to permit an operator to move the stacks of planar material plies into another processing system.

Another object of the present invention is to provide an automated sealing apparatus and method which loads single planar material plies for processing by a sealing device and then loading the single planar material plies into stacks having a predetermined number of planar material plies. The automated apparatus and method provides detecting devices which sense relative positions of the single planar material plies in addition to the stacks of planar material plies.

These and other objects of the present invention are fulfilled by providing an automated apparatus for sealing an edge region of a planar material ply comprising a central controller; a platform; means for picking a single planar material ply; means for moving the single planar material ply to the platform; and means for sealing the edge region of the planar material ply, the sealing means providing a fluid to a predetermined focused region within the edge region, the fluid substantially shrinks and melts strands in the focused region of the planar material ply.

In addition, these and other objects of the present invention are also accomplished by an automated method of sealing an edge region of a planar material ply comprising the steps of: picking a single planar material ply; placing the single planar material ply on a platform; moving a fluid to a heating device; heating the fluid with the heating device; sealing the edge region of the planar material ply by directing the fluid from the heating device towards a predetermined focused region within the edge region, the fluid substantially shrinks and melts strands in the focused region of the planar material ply.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
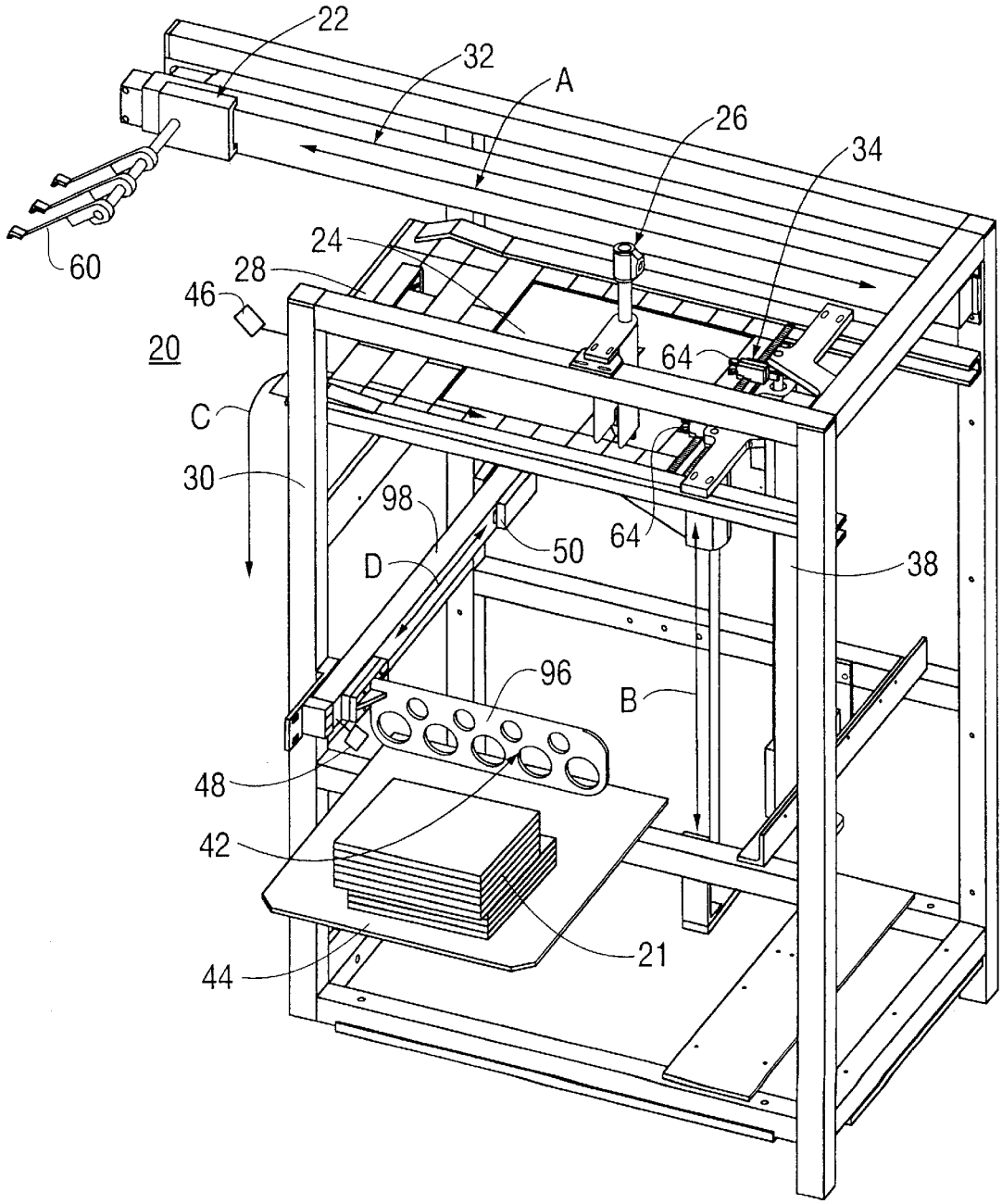
FIG. 1 is a perspective view of an automated sealing apparatus of the present invention.

Referring in detail to the drawings and with particular reference to FIG. 1, an automated sealing apparatus 20 is shown. The automated sealing apparatus 20 further includes a picking station apparatus 22 for moving single planar material plies 24 along a first path with a first defined reference direction A. The automated sealing apparatus 20 further includes means or device 26 for sealing an edge region of the planar material ply 24. Each single planar material ply 24 is, for example, a washcloth made from woven cotton materials.

While the preferred planar material plies include washcloths made from cotton, other materials such as cotton mixtures which include polyester, woven wool fabrics or other like planar materials may be employed in addition to differently shaped pieces of planar materials. Other applications of the automated sealing apparatus 20 of the present invention include, but are not limited to, planar materials such as towels, bathmats, doormats, blankets, articles of apparel such as T-shirts, sweatshirts, and other like planar materials.

It is contemplated that the automated sealing apparatus 20 will be used in an automated manufacturing process where single planar material plies 24 are initially fed by the picking station apparatus 22 for moving the single planar material plies 24 onto a first platform 28 which supports the single planar material plies 24 during sealing thereof by the sealing device 26. As noted above, in a preferred embodiment of the present invention, the single planar material plies 24 are preferably washcloths where the sealing device 26 seals and shrinks over-edge stitches that are run off the edge of a washcloth at the end of a sew cycle. These over-edge stitches are conventionally referred to as "tails" of washcloths. The sealing device 26 provides a fluid with a predetermined temperature to a predetermined focused region within the edge region of the washcloth which includes the over-edge stitches or "tail" of the washcloth.

The automated sealing apparatus 20 further employs a support frame 30 that connects to the picking station apparatus 22, the sealing device 26, and the first platform 28. The automated sealing apparatus 20 further includes means or mechanism 32 which moves the picking station apparatus 22 which holds the single planar material plies 24. The automated sealing apparatus 20 also provides means or a device 34 for moving the planar material plies 24 from the first platform 28 to a second platform 36 (see FIG. 3). The automated sealing apparatus 20 further includes means or a device 38 for moving the second platform 36 along a second defined reference direction B. The first platform 28 moves along a third defined reference direction C according to means or a device 40 (see FIG. 3) for moving the first platform 28. The automated sealing apparatus 20 further employs means or a device 42 for moving planar material plies 24 that have accumulated in stacks 21 on the second platform 36 to a third platform 44.

The moving device 42 for moving the stack, accumulated planar material plies 21 from the second platform 36 to the third platform 44 propagates along a fourth predefined reference direction D.

The automated sealing apparatus 20 further employs numerous means or devices for detecting the presence of single planar material plies 24 and stacks 21 of planar material plies. A device or means 46 detects the presence of planar material plies held by the picking station apparatus 22. A device or means 48 detects accumulated or stacked planar material plies 24 which are disposed on the third platform 44. A device or means 50 detects the presence of the device 42 for moving the accumulated planar material plies 24 from the second platform 36 (see FIG. 3) to the third platform 44.

Figure 2:
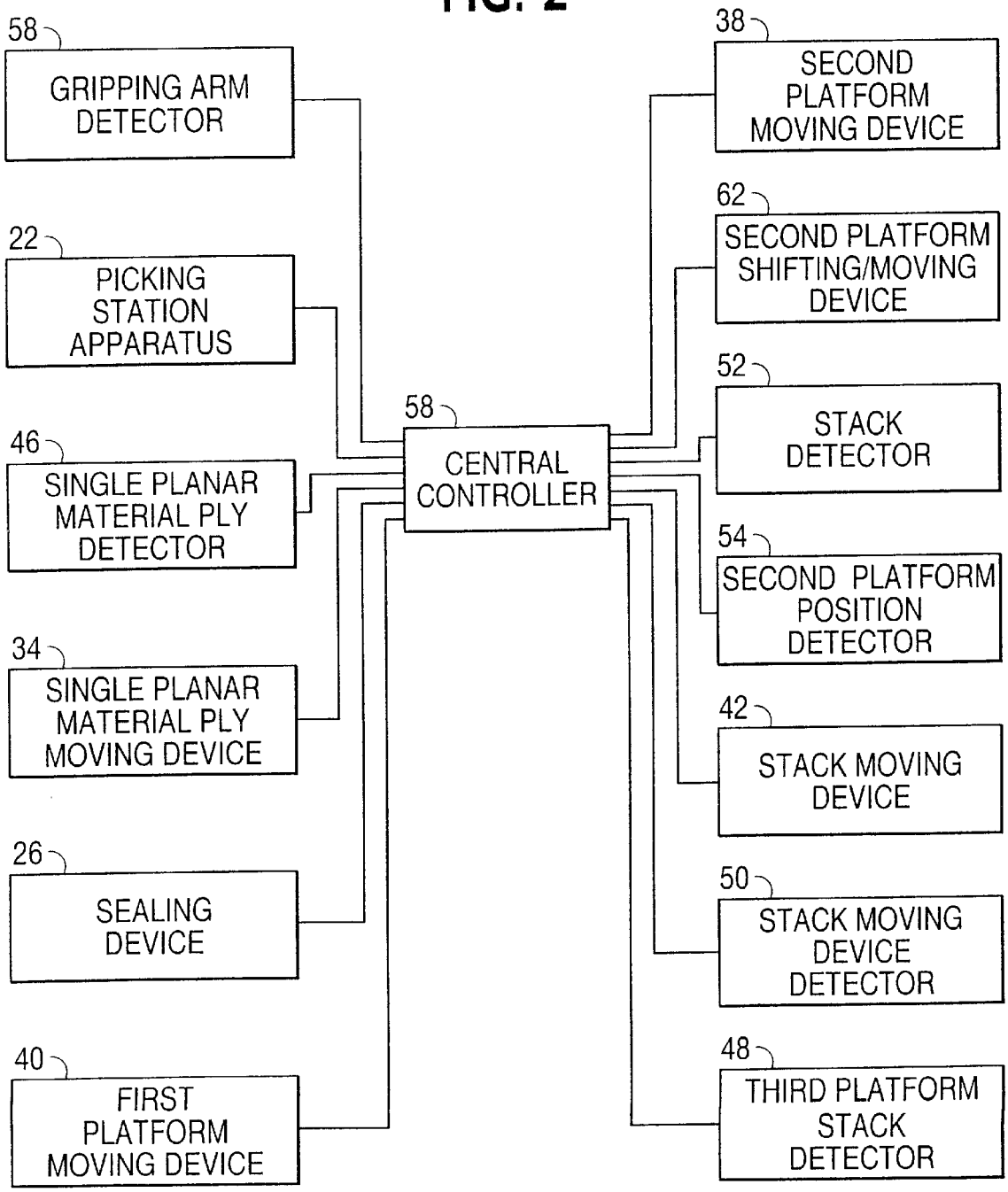
FIG. 2 is a schematic of the control system of the automated sealing apparatus of the present invention.
Figure 3:
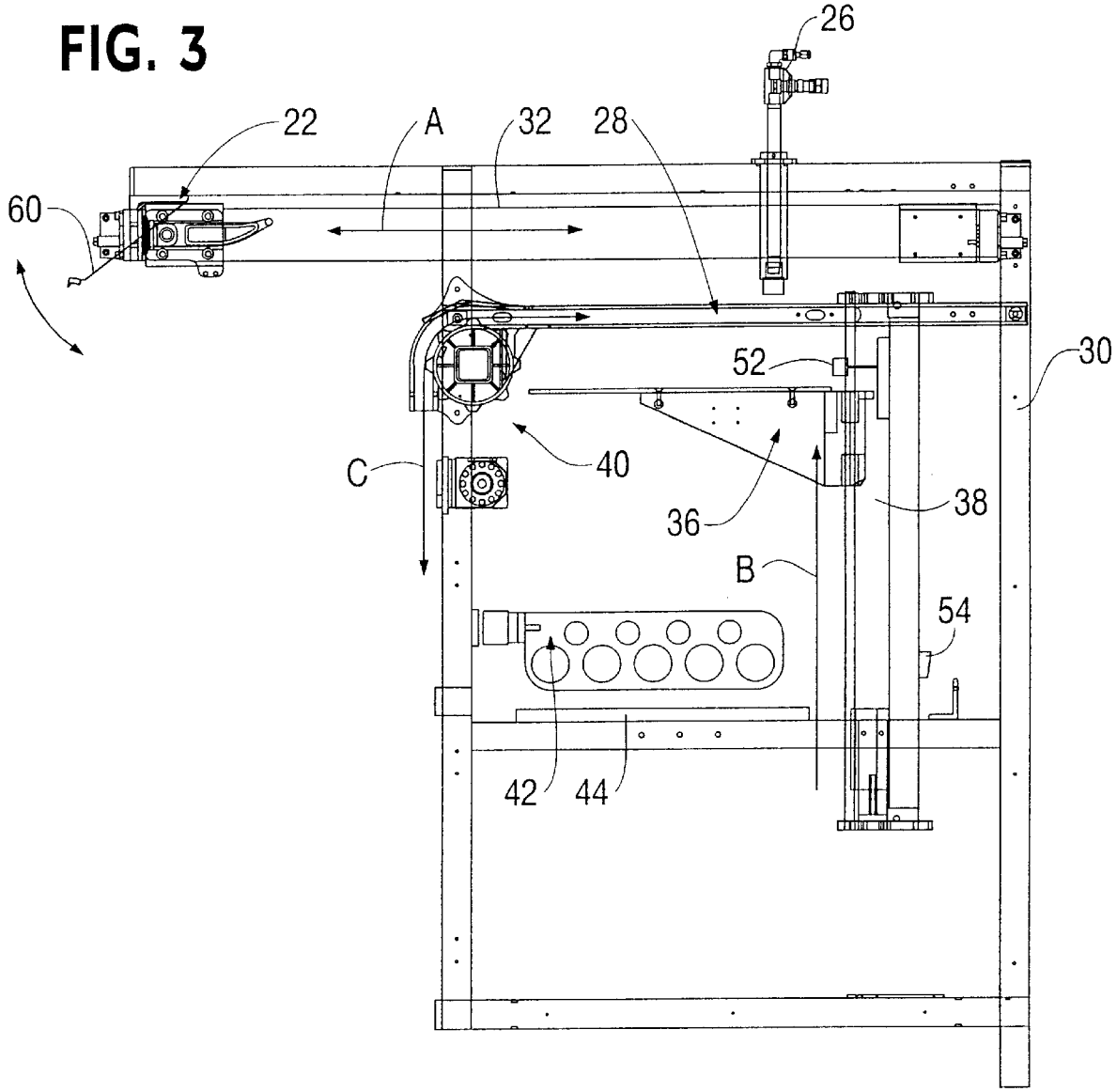
FIG. 3 is a side view of the sealing apparatus.

The automated sealing apparatus 20 further employs means or a device 52 for detecting stacked or accumulated planar material plies 21 on the second platform 36 (see FIG. 3). The automated sealing apparatus 20 further includes means or a device 54 for detecting the position of the second platform 38 along the device 36 for moving the second platform 36 (see FIG. 3). All of the detecting/sensing devices are connected to a central controller 56 (see FIG. 2). The automated sealing apparatus 20 further includes means or a device 58 (see FIG. 8) for detecting the relative position of gripping arms 60 of the picking station apparatus 22.

As seen in FIG. 2 the central or programmable logic controller (PLC) 56 is linked to the following devices: gripping arm detector 58; picking station apparatus 22; single planar material ply detector 46; moving device 34; sealing device 26; first platform moving device 40 (see FIG. 3); second platform moving device 38; second platform shifting/moving device 62 (see FIG. 6); stack detector 52; second platform position detector 54; stack moving device 42; stack moving device detector 50; and third platform stack detector 48. The central controller 56 monitors the position of the single planar material plies 24 and the stacks 21 of planar material plies which travel throughout the automated sealing apparatus with the numerous aforementioned detectors.

The central controller 56 activates the picking station apparatus 22 which includes the picking station moving mechanism 32. The gripping arm detectors 58 (see FIG. 8) provide feedback to the central controller of the relative position of the gripping arm 60. The single planar material ply detector 46 senses the presence of single planar material plies which are grasped by the gripping arms 60. When the picking station apparatus 22 moves a single planar material ply 24 across the first platform 28, the central controller 56 activates the single planar material ply moving devices 34 which include gripping mechanisms 64 (see FIG. 9).

Once a single planar material ply 24 is properly aligned on the first platform 28, the central controller 56 activates the sealing device 26 for a predetermined interval. Upon completion of the sealing of the single planar material ply 24, the central controller activates the first platform moving device 40 which moves the first platform 28 along the reference direction defined by reference numeral C. The single planar material ply moving devices 34 then release the single planar material ply upon the second platform 36. Once the single planar material ply 24 is provided on the second platform 36, the central controller 56 activates moving device 40 to move the first platform 28 into a first position or loading position. The central controller then activates the second platform moving device 38 which causes the single planar material ply 24 present on the second platform 36 to be pressed against a surface of the second platform 36.

After pressing of the accumulated planar material plies 24, the central controller 56 changes the direction of movement of the second platform 36 and lowers the second platform 36 according to height of the accumulated stack 21 of planar material plies detected by the stack detector 52. The central controller 56 continuously monitors the number of accumulated planar material plies on the second platform 36. After a predetermined number of planar material plies 24 are accumulated on the second platform 36, the central controller activates a second platform shifting/moving device 62 (see FIG. 6) which shifts the second platform in a direction parallel to reference direction D.

After a predetermined of stacks 21 or total number of planar planar material plies 24 having accumulated on the second platform 36, the central controller 56 lowers the second platform 36 and activates the stack moving device 42 to push the accumulated stacks onto a third platform 44. The central controller monitors the relative positions of the stacks of planar material plies and position of the stack moving device 42 with a stack moving device detector 50 and a third platform stack detector 48.

The central controller 56 is preferably a programmable general purpose computer, however, other controlling mechanisms are not beyond the scope of the present invention. Other controlling mechanisms include, but are not limited to, hard wired or preprogrammed (fixed data) electronic devices, mechanical configurations which employ multiple gears and/or belts for timing mechanisms, and other like structures.

As seen in FIG. 3, the picking station apparatus 22 includes a moving device 32 which moves the picking station apparatus 22 along reference direction A. The moving device 32 includes a piston cylinder arrangement which is preferably pneumatic. However, the piston cylinder arrangement of the moving device 32 is not limited to pneumatic systems. Other moving mechanisms 32 include, but are not limited to, hydraulic piston cylinder arrangements, lead screw/motor arrangements, geared extending beam assemblies, or other like structures. The single planar material ply detector 46, stack detector 52, and the third platform stack detector 48 are preferably photo electric detectors. The gripping arm detector 58 (see FIG. 8), the second platform position detector 54, and the stack moving detector 50 are preferably magnetic read switches. However, other detectors are not beyond the scope of the present invention. Other types of detectors or sensors include, but are not limited to, fixed focus relative (diffused light-type) sensors, retroreflective photoelectric sensors, mechanical switch arrangements, CCD/video cameras with digital image processors or other like sensing devices.

Figure 4:
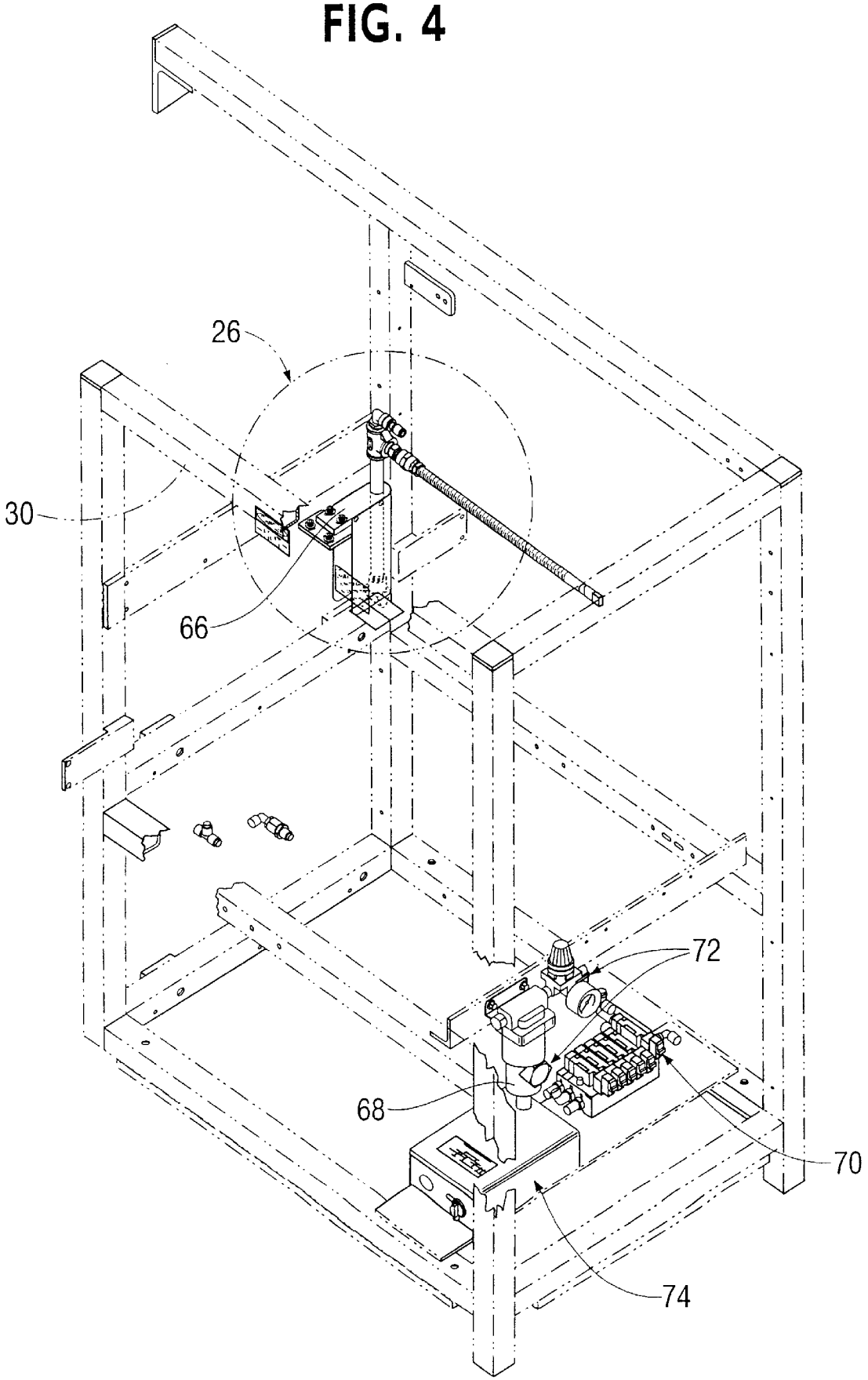
FIG. 4 is perspective of the support frame of the automated sealing apparatus in addition to the sealing device.

In FIG. 4, the sealing device 26 is shown relative to the support frame 30. The sealing device 26 is preferably rigidly mounted to the support frame 30 with a mounting bracket 66. Mounting bracket 66 maintains the sealing device 26 in a predetermined position relative to the single planar material plies 24 which are placed on the first platform 28. While the sealing device 26 is preferably rigidly mounted to the support frame 30, it is not beyond the scope of the present invention to employ mechanical or robotic arm arrangements which can move the sealing device 26 in several different positions. Such movable arrangements would be beneficial for sealing multiple edge regions by moving the sealing device 26 around the perimeter of a planar material ply 24.

In a preferred embodiment, the sealing device 26 is oriented relative to each planar material ply 24 where the sealing device 26 is substantially aligned in a parallel manner with a geometric normal that projects from the surface of the planar material ply 24 being processed. In a preferred embodiment of the present invention, the heating device 26 is spaced from the first platform 28 with a gap which is approximately one half to five eighths of an inch. However, other ranges of the separation between the heating device 26 and the first platform 28 are not beyond the scope of the present invention depending upon the type and thickness of planar material plies 24 being processed.

The sealing device 26 preferably includes a heating element which heats a fluid medium that propagates through the sealing device 26. The fluid medium is preferably air, but other fluid mediums such as water are not beyond the scope of the present invention. Other fluid mediums include, but are not limited to, water vapor and/or steam, coloring dyes, sealants and other like fluids. The sealing device further includes means or a device 68 for removing contaminants from the fluid. The contaminant removing device 68 increases the heating element life of the sealing device 26 by substantially reducing any contaminants which come in contact with the heating element. The contaminant removal device 68 is preferably an air dryer but other types of contaminant removing devices are not beyond the scope of the present invention. Other contaminant removing devices include, but are not limited to, screen filters, valve arrangements, and other like structures.

The sealing device 26 further includes means or devices 70 which can maintain constant flow or intermittent flow of fluid to the sealing device 26. The flow maintenance device 70 is preferably a regulator/valve arrangement which is connected to an air compressor (not shown). The sealing device 26 further includes means or a device 72 for displaying fluid flow data. The fluid flow data displaying device 72 is preferably an analog pressure gauge. However, other fluid flow data devices are not beyond the scope of the present invention and can include digital fluid flow data display devices, output ports which are coupled to data input ports of a general purpose computer, and other like fluid flow data display devices.

The sealing device 26 preferably includes a heating device controller 74 which can be coupled to the central controller 56 or it can operate in a stand alone mode. The heating device controller 74 typically includes the hardware, and or software necessary to cycle the heating element of the sealing device 26 in "On" and "Off" states where fluid flows intermittently through the sealing device 26. Typically "On" intervals are at approximately one second in length while "Off" intervals are eight seconds in length. However, other predetermined time periods may be employed depending upon the type of planar material plies 24 being sealed.

The heating device controller 74 which can be coupled to or included in the central controller 56 provides instantaneous response to setting or load changes within the sealing device 26. The heating device controller 74 substantially reduces thermal lag or overshoot and substantially prevents elements breakdown of the nickel alloy heating element disposed within the conduit 78. The heating device controller 74 is preferably an AVATAR TSS series controller which can be used with low mass self-sensing heaters, such as ALUMEL, BALCO, nickel or tungsten heating elements. The heating device controller 74 preferably uses the heating element itself as a resistance temperature detector which eliminates any need for other temperature sensors. The heating device controller 74 includes a phased angle fired relay in addition to potentiometers to control the nickel alloy heating element disposed within the conduit 78. As stated above, other heating device controllers are not beyond the scope of the present invention. Other heating controllers include, but are not limited to, hard wired or preprogrammed (fixed data) electronic devices, mechanical configurations which employ analog instrumentation or other like heating control devices.

Figure 5:
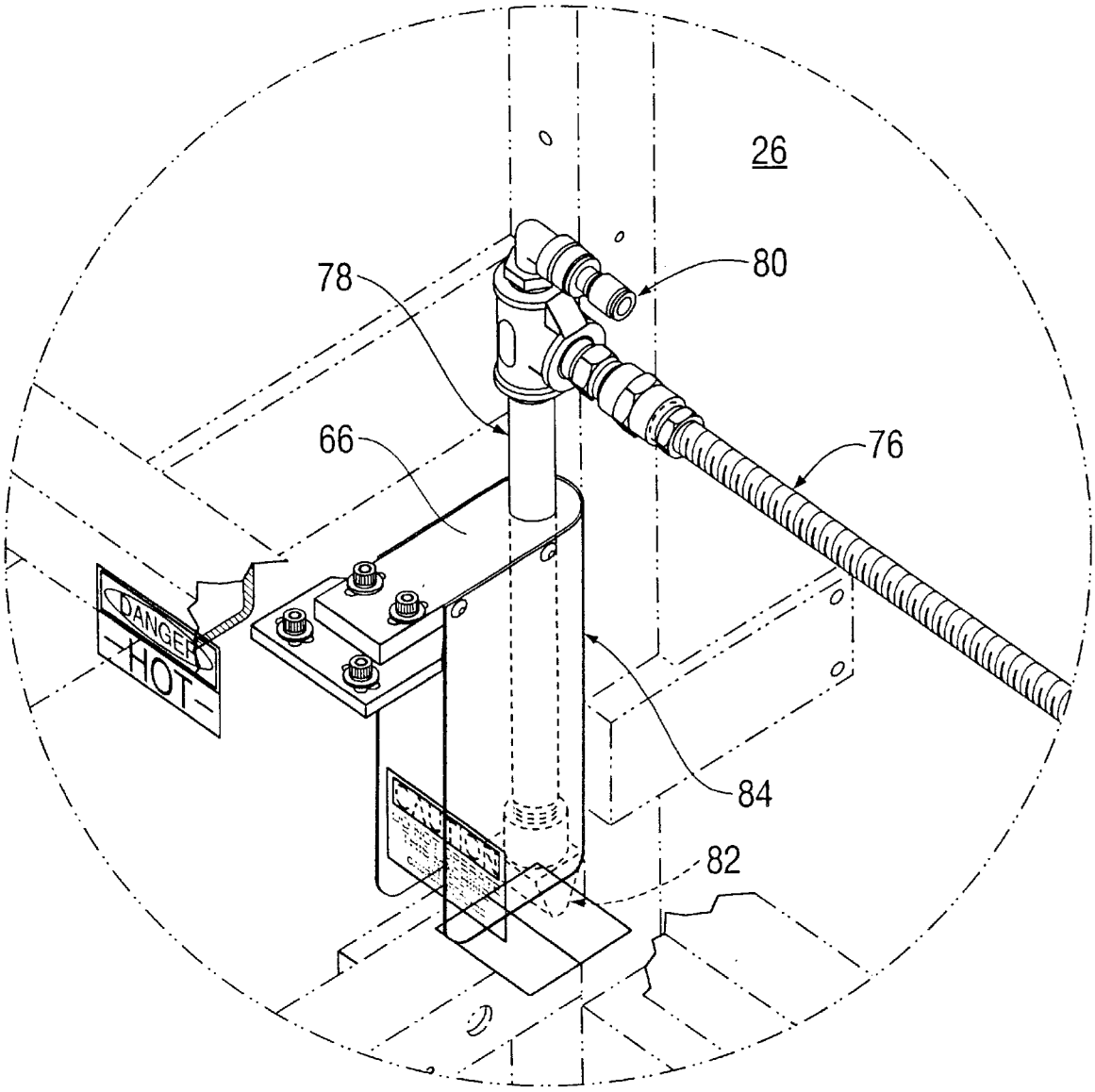
FIG. 5 is a close-up view of the sealing device of the present invention.

As seen in FIG. 5, the sealing device 26 includes a conduit 76 which provides power for the heating element. The heating element (not shown) is disposed within a conduit 78. The heating element is preferably a nickel alloy heating element which does not burn out after numerous cycles of on and off periods. The heating element disposed within conduit 78 is preferably a SYLVANIA 4.5 ohm BALCO heater.

The nickel alloy heating element which is disposed within conduit 78 permits the intermittent heating of fluid which is cycled through the conduit 78. In other words, during intermittent fluid flow, the heating element disposed within conduit 78 is turned "On" when fluid flows through the conduit 78. The heating element is turned "Off" when fluid does not flow through conduit 78. In other words, the heating element is powered with electricity during "On" periods of fluid flow and the heating element is not powered with electricity during "Off" periods where fluid does not flow through conduit 78. As stated above, the preferred embodiment of the invention cycles fluid flow on for one second of time and off during eight second periods of time.

The heating element of the sealing device 26 is preferably designed to heat the air propagating through the conduit 78 to approximately 650–850° F. However, other temperatures are not beyond the scope of the present invention depending upon the type of planar material plies being processed. The heating element of the sealing device 26 is not limited to the electrical heating element and can include other heating elements such as heat exchangers coupled with other fluid mediums, combustion-type heating type elements, and other like structures.

It is contemplated that fluid will flow through conduit 78 which is fed by inlet valve 80. Inlet valve 80 connects to a conduit (not shown) that connects to the fluid flow data device 72 and fluid flow device 70 (shown in FIG. 4). The pressure of the fluid medium flowing out of conduit 78 is preferably between 3–4 p.s.i. Pressure settings greater than this range will result in the fluid medium moving the planar material plies 24 away from the sealing device 26. The sealing device 26 further includes a nozzle 82 which directs the fluid flowing through conduit 78 to a predetermined focused region within an edge region of the single planar material plies 24. The nozzle geometry can be adjusted to increase or decrease the focused region depending upon the type of planar material plies 24 being processed. A shield or guard 84 is supported by the sealing device bracket 66 in order to prevent an operator and/or materials being processed from contacting the conduit 78 which is heated by the heating element disposed therein.

Figure 6:
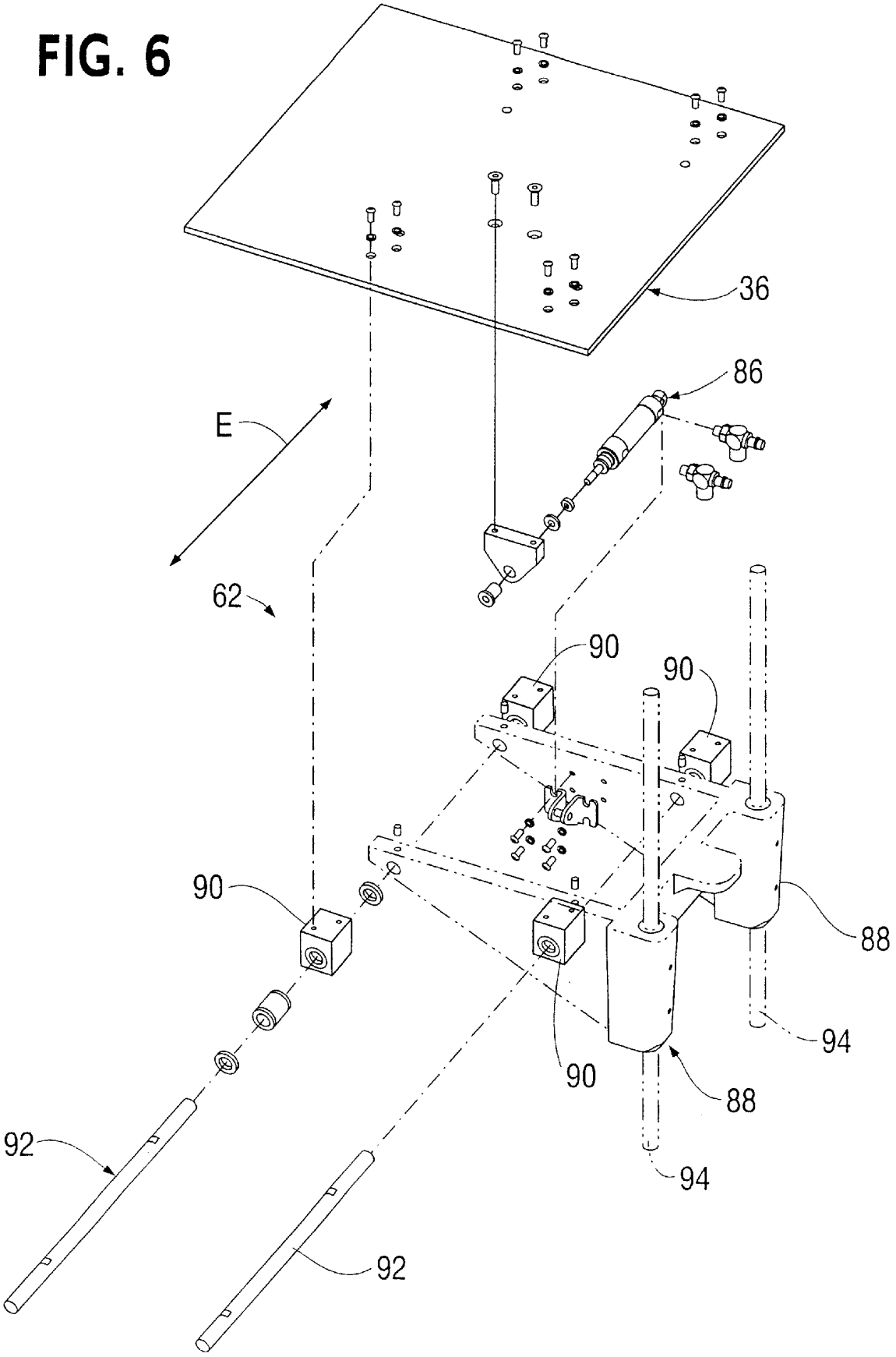
FIG. 6 is perspective view of the elevator assembly of the present invention.

In FIG. 6, further details of the second platform 36 and the second platform moving/shifting mechanism 62 are shown. The second platform shifting/moving device 62 includes a piston cylinder arrangement 86 which couples the second platform 36 to a plate elevator casting 88 which is part of the moving device 38 for the second platform. The moving device 38 for the second platform 36 is similar to the moving device 32 for the picking station apparatus 22. However, the piston cylinder arrangement of the moving device 38 is not limited to pneumatic systems. Other moving mechanisms include, but are not limited to, hydraulic piston cylinder arrangements, lead screw/motor arrangements, geared extending beam assemblies, or other like structures.

The second platform 36 is further coupled to bearing blocks 90 which move along stationary rods 92. The second platform moving or shifting device 62 is not limited to the piston cylinder arrangement 86 and the bearing blocks 90 in stationary rods 92. Other shifting or moving devices 62 include, but are not limited to, geared extendible bearings, sliding arrangements coupled with positioning motors, or multiple gear configurations or other like substitute shifting devices.

Referring to FIGS. 3 and 6, the second platform 36 is moved along predefined reference direction B by a moving device 38 and the platform is also moved or shifted along predefined reference direction E by moving or shifting device 62. After each planar material ply is placed on the second platform 36, the moving device 38 moves the second platform 36 along predefined reference direction B so that the accumulated planar material plies 24 are pressed against the first platform 28.

After pressing the planar material plies 24 which have accumulated on the second platform 28, the moving device 38 lowers the second platform 36 from the first position (adjacent the first platform 28) to a second predetermined position along predefined reference direction B in accordance with the stack height detector 52. The compression of the planar material plies 24 against the first platform 28 ensures that each planar material ply rests on the second platform 36 in a substantially smooth manner with a minimal amount of volume required for storage.

The shifting or moving device 62 moves the second platform 26 along predefined reference direction E according to a respective number of planar material plies 24 present in a stack 21. When a stack 21 of accumulated planar material plies reaches a predetermined number, the central controller 56 activates the moving or shifting mechanism 62 so that the second platform 36 is displaced along predefined reference direction E from a third position (where a first stack 21 of planar material plies have been accumulated) to a fourth position (so that a second stack 21 of accumulated planar material plies will be offset relative to the respective first stack 21).

The moving or shifting device 62 facilitates the ease of separation between multiple stacks so that an operator may easily separate respective stacks 21 that could be made of different planar material plies. In other words, multiple stacks 21 can be comprised of different types of planar materials, such as terrycloth-type washcloths in one stack 21 and simple woven cotton smooth-type washcloths in a second stack 21. The relative offsetting of respective stacks 21 also permits an operator to count the number of planar material plies in an overall stack which comprises the grouping of smaller offset stacks 21 of planar material plies 24.

The moving device 38 for the second platform 36 includes plate elevator castings 88 which move along stationary rods 94. However, the moving device 38 is not limited to this plate elevator casting 88 and stationary rod 94 arrangement. Other types of elevating arrangements include, but are not limited to, geared extendible bearings, sliding arrangements coupled with positions motors, pulley and cable arrangements, hydraulic piston cylinder arrangements, or multiple gear configurations, or other like structures.

The second platform 36 preferably has a rectangular shape in order to support planar material plies 24 that also preferably have a rectangular shape. However, the second platform 36 is not limited to the rectangular shape shown in the drawings. Therefore, depending on the shape or arrangement of the adjacent supporting structures and the shape of the planar material plies 24 which are to be worked upon, the second platform 36 can have many different shapes. Other shapes of the second platform 36 include, but are not limited to, triangular, pentagonal, octagonal, elliptical, or other like polygonal shapes.

As seen in FIG. 1, the moving device 42 for moving the accumulated planar material plies from the second platform 36 to the third platform 44 includes a stack engaging moving arm 96. The stack engaging arm 96 is coupled to a moving device 98 which displaces the stack engaging arm 96 along predefined reference direction D. Similar to moving device 32, the moving device 98 preferably includes a pneumatic piston cylinder arrangement. However, other displacement or extending mechanisms are not beyond the scope of the present invention. Other extending mechanisms include, but are not limited to, hydraulic piston cylinder arrangements, lead screw/motor arrangements, gear extending beam assemblies or other like structures. The stack engaging arm 96 is preferably rectangular in shape. The stack engaging arm 96 is not limited to a rectangular shape and can have many other shapes depending upon the size of the stacks of planar material plies 24. Other shapes of the stack engaging arm 96 include, but are not limited to, triangular, square, pentagonal, octagonal, hexagonal, elliptical, or other polygonal shapes. The stack engaging arm is not limited to a planar surface and can include other types of moving mechanisms or grasping mechanisms. Other types of moving and/or grasping mechanisms include gripping arm assemblies, Walton pickers, geared or pneumatic actuated grasping members, or other like structures.

Figure 7:
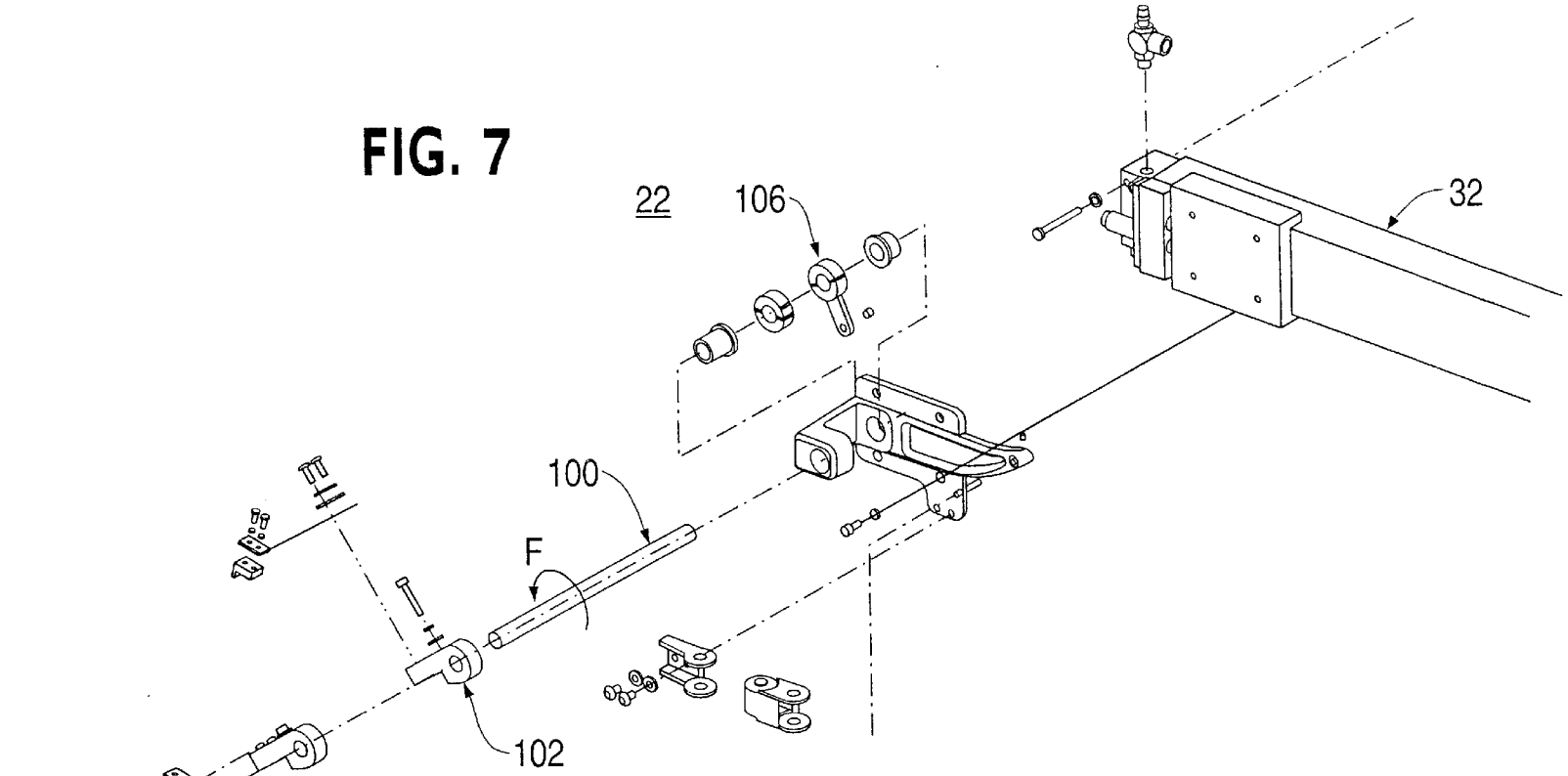
FIG. 7 is a close-up perspective view of the gripping mechanism of the present invention.

Further details of the picking station apparatus 22 which includes gripping arms 60 are shown in FIG. 7. The picking station apparatus 22 includes gripping arms 60 which are connected to a shaft 100. Each of the gripping arms 60 includes an arm clamp 102 which facilitates connection of the gripping arm 60 to the shaft 100. Shaft 100 is rotated by a piston cylinder arrangement 104 (shown in FIG. 8). The shaft 100 is connected to the piston cylinder arrangement 104 by a clamp 106. Each of the gripping arms 60 includes projections or cloth grabbers 110 which engage with each of the planar material plies 24. The projections 110 are preferably made out of rubber so that when shaft 100 is rotated along defined reference direction F, the gripping arms 60 rotate along this defined reference direction F to press the planar material plies against a substantially planar surface (now shown) adjacent to the sealing device 20 while the picking station apparatus 22 is moved along defined reference direction A.

The gripping arms 60 continue to press each planar material ply 24 against the planar surface (not shown) adjacent to the automated sealing apparatus 20 and continue to press the planar material plies 24 against the first platform 28 by moving along the predefined reference direction A. The picking station apparatus presses each planar material ply 24 while also sliding each planar material ply along the substantially planar surface (not shown) adjacent to the automated sealing apparatus 20 and across the first platform 28 until the moving devices 34 engage with the planar material ply 24. While the present invention contemplates the use of gripping arms 60 which press the planar material plies 24 against planar surfaces, other types of gripping arm devices such as Walton pickers, geared or pneumatic actuating grasping members or the like may be employed.

Figure 8:
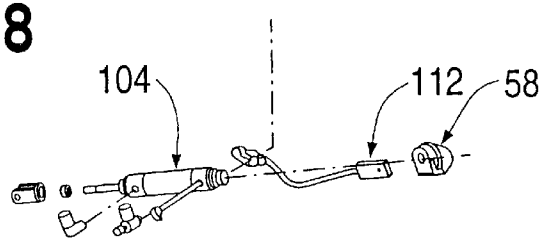
FIG. 8 is a close-up perspective view of an actuator and detector device and one of the gripping mechanisms of the present invention.

In FIG. 8, further details of the piston cylinder arrangement 104 are shown. The central controller 56 monitors the relative position of the gripping arm 60 by detector 58 and a switch 112. The piston cylinder arrangement 104 is preferably pneumatic, but other types of piston cylinder arrangement or extending mechanism may be employed. Other types of extending mechanisms or piston cylinder arrangements include hydraulic piston cylinder arrangements, lead screw/motor arrangements, gear extending beam assemblies or other like structures. The gripping arm detector 58 and switch 112 are preferably a mechanical switch arrangement. However, other types of detecting devices are not beyond the scope of the present invention. Other type of detecting devices includes, but are not limited to, encoder/decoder detectors, infrared mirror combinations, CCD/video cameras with digital image processors, or other like detecting devices may be employed.

Figure 9:
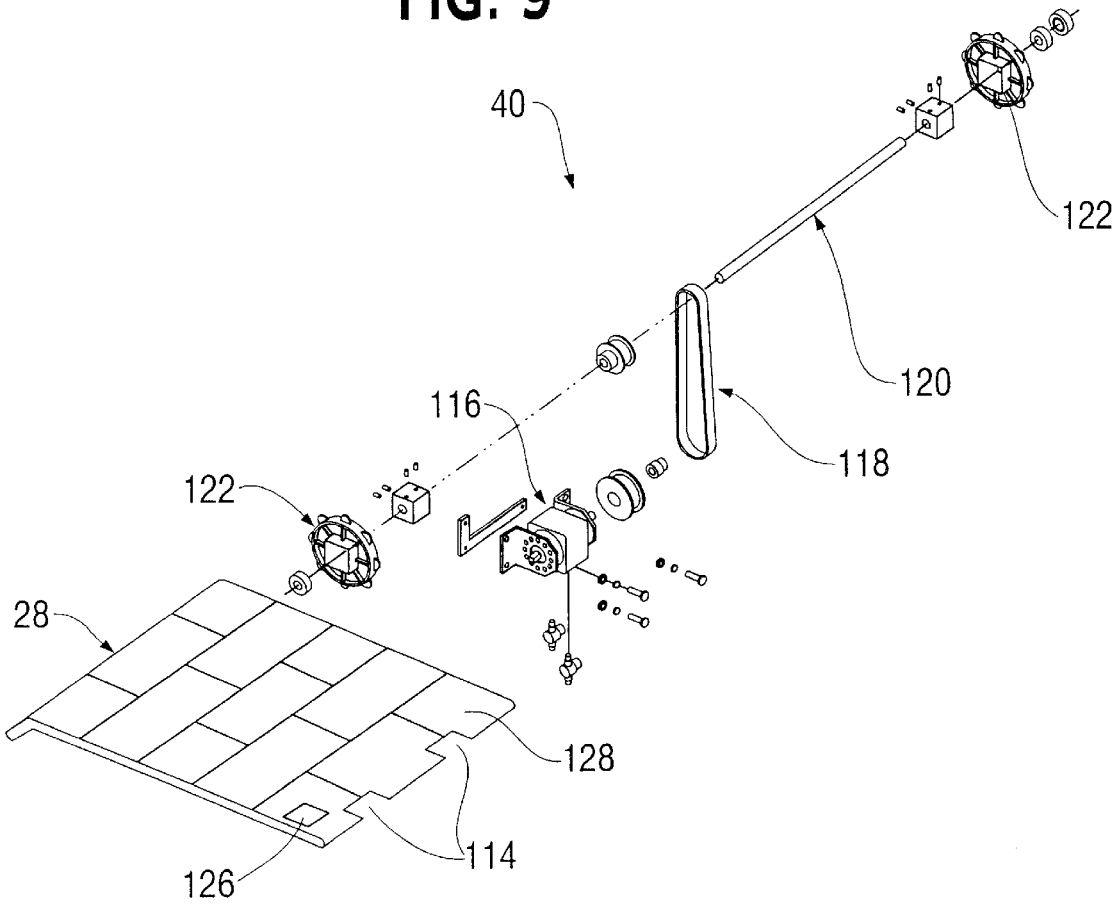
FIG. 9 is a perspective view of the first platform and moving device thereof of the present invention.

In FIG. 9, further details of the first platform 28 are shown. The first platform 28 includes notches 114 which permit grasping of the planar material ply by the moving device 34. The first platform 28 is preferably made out of a linked hard plastics material which provides a solid surface when the first platform is in the first position and a movable or compressible surface in the second position. In other words, the first platform is made up of a series of linked longitudinal elements which is similar to conveyor mechanisms. The first platform 28 is displaced with moving device 40 which includes a air rotary actuator 116 which drives a belt 118. The belt 118 rotates a shaft 120 which in turn rotates sprockets 122 which engage with the first platform 28. The moving device 40 of the first platform 28 is not limited to the air rotary actuator 116. Other type of driving mechanisms include, but are not limited to, variable speed frequency AC motors, hydraulic motors, stepper motors, or other like driving mechanisms.

The first platform 28 is preferably a partial INTERLOX belt (a continuous plastic conveyor belt) or other types of belts, such as rubber, metallic plated or other like belts may be employed. In a preferred embodiment, the links of the INTERLOX belt which are adjacent to the sealing device 26 are preferably made out of aluminum in order to serve as a heat sink. In other embodiments, the INTERLOX belt may be entirely made out of plastic, however, a heat reflective tape is employed near the linkages which are adjacent to the sealing device 26. See FIG. 9 where reference numeral 126 denotes a region where heat reflective tape can be employed on an end linkage 129 of the first platform 28 which is made of an INTERLOX type belt assembly. As stated above, in the alternative to employing a heat reflective tape in the region denoted by reference numeral 126, and end linkage 128 may be made out of aluminum to serve as a heat sink for the heat being emitted from the sealing device 26.

Figure 10:
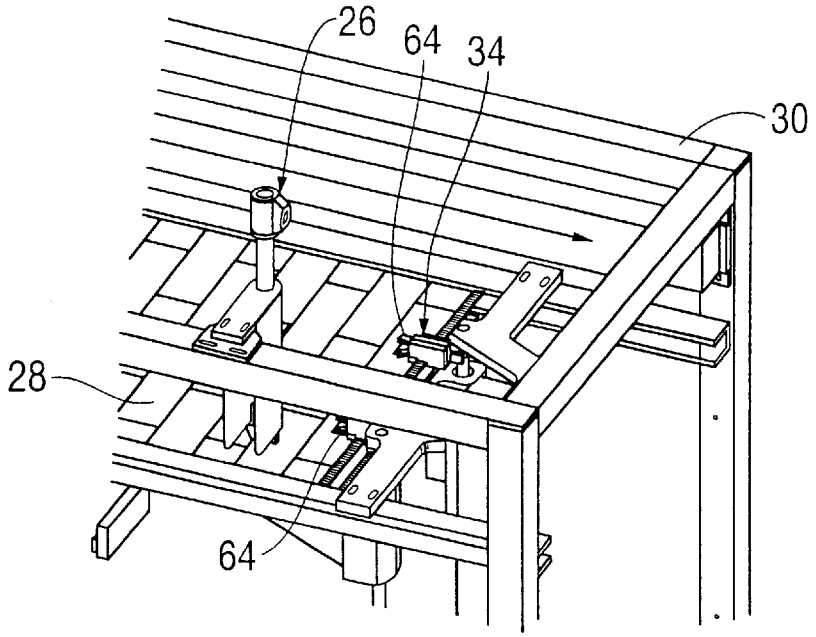
FIG. 10 is a perspective view of the first platform and the moving device which transfers each planar material ply from the first platform to the second platform.
Figure 11:
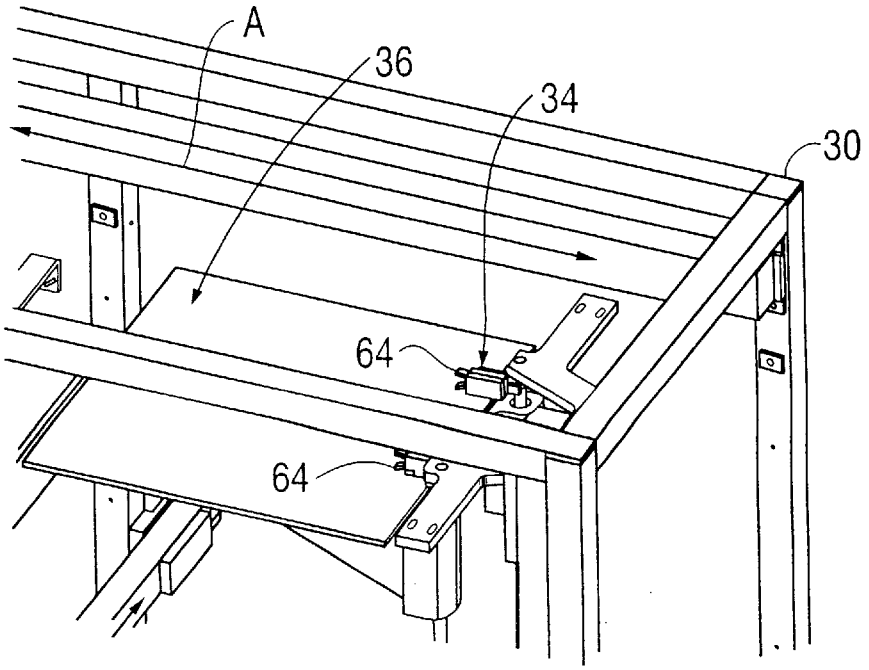
FIG. 11 is a perspective view of the second platform of the present invention.

In FIGS. 10 and 11, further details of the moving device 34 which includes gripping mechanisms 64 are shown. Gripping mechanisms 64 grasp edge regions of the planar material plies 24 which are moved across the first platform 28 by the picking station apparatus 22. When the picking station apparatus 22 reaches a predetermined position on the first platform 28, the gripping mechanisms clamp onto to edge regions of the planar material plies 24. The notches 114 in the first platform 28 permit the gripping mechanisms 64 to contact both sides of the planar material plies 24. After a planar material ply 24 is sealed by the sealing device 26, the first platform 28 moves along predefined reference direction C while the gripping mechanisms 64 continuously hold edge regions of each planar material ply 24 so that gravity causes the planar material plies 24 to fall onto the second platform 36. Once the planar material plies 24 contact either the second platform 36 or accumulated planar material plies 24/stacks 21 present on the second platform 36, the gripping mechanisms 64 release the edge regions of each planar material ply 24. The gripping mechanisms 64 are preferably pneumatically actuated. However, other gripping mechanisms 64 are not beyond the scope of the present invention. Other gripping mechanisms include, but are not limited to, Walton pickers, arm members actuated by gears, hydraulically actuated contact members, or other like structures may be employed.

The first platform 28 is preferably made out of plastic, but other types of belts such as rubber, metallic plated or other like belts may be employed. The support frame 30, the second platform 36, third platform 44 are preferably made of steel. However, other materials are not beyond the scope of the present invention. Other materials include, but are not limited to, ferrous alloys, non-ferrous alloys, ceramic materials, polymers, composite materials and other like structures.

The automated sealing apparatus 20 provides an automated method of sealing an edge region of a planar material ply 24. The automated method includes picking a single planar material ply 24 and placing the single planar material ply 24 on a first platform 28. The automated method further provides for the movement of a fluid through a heating device disposed in a conduit 78. The planar material plies 24 are then sealed in an edge region by fluid flowing through and out of a nozzle 82 connected to a conduit 78. The nozzle 82 directs the fluid flowing through the conduit 78 towards a predetermined focused region which is within an edge region of the planar material plies 24. The fluid substantially shrinks and melts strands in the focused region of the planar material ply 24.

After sealing the planar material ply 24, the moving device 34 which includes gripper arm assemblies continue to hold the planar material ply 24 while the moving device 40 for the first platform is activated. When the first platform 28 is moved along the defined reference direction C to a position which is parallel to the sealing device 26, the moving device 34 releases the planar material ply upon the second platform 36. Once the planar material ply is placed on the second platform 36, the first platform 28 is moved along predefined reference direction C so that it rests in a position that is perpendicular to the sealing device 26. The moving device 38 then moves the second platform 36 toward the first platform 28 and presses the planar material ply 24 against a surface of the first platform 28.

After pressing, the moving device 38 lowers the second platform 36 to a predetermined position according to data received by sensor 52. After a predetermined number of planar material plies 24 have accumulated on the second platform 36, the moving or shifting mechanism 62 is activated to move the second platform from a third position (where a first stack 21 of planar material plies 24 have accumulated) to a fourth position (where a second stack 21 of planar material plies 24 will accumulate offset relative to the first stack).

After a predetermined number of planar material plies have been counted by the central controller 56, or in the alternative if detector 54 senses the second platform 36, the moving device 38 moves the second platform 36 to a position which is parallel with the third platform 44. The central controller then activates a moving device 42 for moving the stack planar material plies 21 onto the third platform 44.

The method also provides the automatic detection of the position of the gripping arms 60 of the picking station apparatus 22 and detecting the presence of planar material plies 24 held by the gripping arm 60. The method also provides the sending of a signal from the heating device disposed within the conduit 78 to the central controller 56. The method further includes steps of intermittently moving fluid to the heating device disposed within the conduit 78 for predetermined intervals.

The method also provides the removal of contaminants from the fluid prior to heating the fluid within the conduit 78 and displaying fluid flow data with a fluid flow data device 72. The method also provides a step of removing contaminants from the fluid by preheating the fluid with a dryer 68.

The sealing method also provides steps of changing power levels to the heating device within the conduit 78 in accordance with the flow of fluid through conduit 78 and/or the electrical resistance of the heating device disposed within the conduit 78. Such changes are monitored by a heating device controller 74 or the central controller 56. The central controller 56 or the heating controller 78 further monitor the temperature of the heating device disposed within the conduit 78 according to changes of the electrical resistance of the heating device. The method also provides for the step of displaying heating device data within a display unit on the heating device controller 74 or on a screen coupled to the central controller 56.

The present invention provides an automated sealing apparatus and method which seals an edge region of planar material plies where the sealing device provides a fluid which substantially shrinks and melts strands in a focused region in the edge region of the planar material ply. The automated sealing apparatus and method is capable of handling multiple planar material plies and stacking the sealed planar material plies. The automated sealing apparatus and method can continuously run without an operator's constant supervision. The automated sealing apparatus and method closely parallels the manual sealing of planar materials but permits the continuous movement of the single planar material plies.

The automated sealing apparatus and method seals single planar material plies in a rapid manner with fewer errors and inconsistencies which in turn increases the overall quality control of the planar material plies. The present invention substantially reduces the amount of operator time required in the sealing of the planar material plies. The automated sealing apparatus and method includes a sealing device that can be cycled on and off at predetermined times in accordance with the loading and unloading of planar material plies. The present invention provides an automated sealing apparatus and method which employs a heating device which can be cycled on and off during predetermined times in accordance with the loading and unloading of planar material plies.

The present invention provides an automated sealing apparatus and method which counts the number of planar material plies that are processed in addition to forming stacks of planar material plies of a predetermined number which are offset relative to each other. This offsetting of stacks of planar material plies facilitates ease of separation between respective stacks of planar material plies that have a predetermined number of planar material plies.

The automated sealing apparatus and method compresses stacks of planar material plies as single planar material plies which are loaded on a respective stack in order facilitate reduction of storage space for respective stacks of planar material plies. The automated sealing apparatus and method unloads a predetermined number of stacks of planar material plies onto a platform outside of an elevator arrangement to permit an operator to move the stacks of planar material plies into another processing system.

The automated sealing apparatus and method loads single planar material plies for processing by a sealing device and then loads the single planar material plies into stacks having a predetermined number of planar material plies. The automated apparatus and method provides detecting devices which sense relative positions of the single planar material plies in addition to the stacks of planar material plies.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. An automated apparatus for sealing an edge region of a planar material ply comprising:

a central controller;

a platform;

means for picking a single planar material ply, said picking means includes a gripping mechanism and means for detecting the position of said gripping mechanism;

means for moving the single planar material ply to said platform; and means for sealing the edge region of the planar material ply, said sealing means providing a fluid to a predetermined focused region within the edge region, the fluid substantially shrinks and melts strands in the focused region of the planar material ply.

2. The automated apparatus for sealing an edge region of a planar material ply of claim 1, wherein said sealing means further includes means for heating a fluid, the automated apparatus further comprising:

means for channeling a fluid; and means for moving the fluid through said means for channeling and to said means for heating, said means for heating being responsive to said controller.

3. The automated apparatus for sealing an edge region of a planar material ply of claim 2, wherein said means for channeling includes a plurality of conduits, and said means for heating includes an electrical heating element disposed in a conduit.

4. The automated apparatus for sealing an edge region of a planar material ply of claim 1, wherein said platform is a first platform, the automated apparatus further comprising a second platform and means for moving the second platform from a first position to a second position.

5. The automated apparatus for sealing an edge region of a planar material ply of claim 4, further comprising:

means for detecting a relative position of the second platform; and means for detecting a height of planar material plies stacked on the second platform.

6. The automated apparatus for sealing an edge region of a planar material ply of claim 1, wherein said platform is a first platform, the automated apparatus further comprising:

means for moving the first platform from a first position to a second position;

a second platform; and means for moving the planar material ply from the first platform to a second platform.

7. The automated apparatus for sealing an edge region of a planar material ply of claim 6, further comprising:

means for sending a signal representing a number of planar material plies accumulated on the second platform; and means for moving the second platform from a first position to a second position.

8. The automated apparatus for sealing an edge region of a planar material ply of claim 7, further comprising means for moving the second platform from a third position to a fourth position, whereby a predetermined number of planar material plies are placed in a first stack which is offset from a second stack in order to facilitate ease of separation between the first and second stacks.

9. The automated apparatus for sealing an edge region of a planar material ply of claim 1, further comprising:

means for detecting presence of a planar material ply held by the gripping mechanism; and means for sending a signal from said sealing means to said central controller.

10. The automated apparatus for sealing an edge region of a planar material ply of claim 1, further comprising means for intermittently moving the fluid through said sealing means for predetermined intervals.

11. The automated apparatus for sealing an edge region of a planar material ply of claim 1, further comprising:

means for moving planar material plies accumulated on the second platform away from the second platform to a third platform; and means for detecting planar material plies on the third platform.

12. The automated apparatus for sealing an edge region of a planar material ply of claim 1, further comprising:

means for removing contaminants from the fluid;

means for displaying fluid flow data; and means for maintaining a flow of the fluid to said sealing means.

13. The automated apparatus for sealing an edge region of a planar material ply of claim 12, wherein said means for removing contaminants from the fluid includes a dryer.

14. The automated apparatus for sealing an edge region of a planar material ply of claim 12, wherein the predetermined orientation is defined by the sealing means being aligned in a parallel manner with a geometric normal projecting from the planar material ply.

15. The automated apparatus for sealing an edge region of a planar material ply of claim 1, further comprising means for sending a signal from the sealing means to the central controller, said central controller changes power levels to said sealing means in accordance with at least one of movement of the fluid and electrical resistance of said sealing means.

16. The automated apparatus for sealing an edge region of a planar material ply of claim 1, wherein said central controller monitors temperature of sealing means according to changes of electrical resistance of said sealing means.

17. The automated apparatus for sealing an edge region of a planar material ply of claim 1, wherein said sealing means has a predetermined orientation relative to the planar material ply whereby the fluid exiting said sealing means heats and seals predetermined stitches in the edge region of the planar material ply.

18. The automated apparatus for sealing an edge region of a planar material ply of claim 1, wherein said central controller includes me an s for displaying data indicating status information of said sealing means.

19. An automated method of sealing an edge region of a planar material ply comprising the steps of:

picking a single planar material ply;

placing the single planar material ply on a platform;

moving a fluid to a heating device;

heating the fluid with the heating device;

sealing the edge region of the planar material ply by directing the fluid from the heating device towards a predetermined focused region within the edge region, the fluid substantially shrinks and melts strands in the focused region of the planar material ply;

automatically detecting the position of a gripping mechanism;

automatically detecting presence of a planar material ply held by the gripping mechanism.

20. The method of claim 19, wherein the platform is a first platform, the method further comprising the steps of:

moving the first platform from a first position to a second position; and moving the planar material ply from the first platform to a second platform.

21. The method of sealing an edge region of a planar material ply of claim 20, further comprising the step of moving the second platform from a first position to a second position.

22. The method of sealing an edge region of a planar material ply of claim 21, further comprising the steps of:

sending a counting signal representing a number of planar material plies accumulated on the second platform;

placing a predetermined number of planar material plies in a first stack;

moving the second platform from a third position to a fourth position;

placing a predetermined number of planar material plies in a second stack which is offset from the first stack, in order to facilitate ease of separation between the first and second stacks.

23. The method of sealing an edge region of a planar material ply of claim 20, further comprising the steps of:

sending a signal to a central controller indicating a relative position of the second platform; and sending a signal to central controller indicating height of planar material plies stacked on the second platform.

24. The method of sealing an edge region of a planar material ply of claim 20, further comprising the step of pressing the planar material plies accumulated on the second platform against the first platform.

25. The method of sealing an edge region of a planar material ply of claim 20 further comprising the steps of:

moving a predetermined number of planar material plies accumulated on the second platform away from the second platform to a third platform; and sending a signal to the central controller indicating the presence of planar material plies on the third platform.

26. The method of sealing an edge region of a planar material ply of claim 19, further comprising the step of sending a signal from the heating device to a central controller.

27. The method of sealing an edge region of a planar material ply of claim 19, further comprising the step of intermittently moving the fluid to the heating device for predetermined intervals.

28. The method of sealing an edge region of a planar material ply of claim 19, wherein the platform is a first platform, further comprising the steps:

moving a second platform from a first position to a second position.

29. The method of sealing an edge region of a planar material ply of claim 19, further comprising the steps of:

removing contaminants from the fluid prior to step of heating the fluid;

displaying fluid flow data; and maintaining a constant flow of the fluid to said heating device.

30. The method of sealing an edge region of a planar material ply of claim 29, wherein the step of removing contaminants from the fluid includes preheating the fluid with a dryer.

31. The method of sealing an edge region of a planar material ply of claim 19, wherein the sealing step includes heating and sealing predetermined stitches in the edge region of the planar material ply.

32. The method of sealing an edge region of a planar material ply of claim 19, further comprising the step of changing power levels to the heating device in accordance with at least one of movement of the fluid and electrical resistance of said heating device.

33. The method of sealing an edge region of a planar material ply claim 19, further comprising the step of monitoring temperature of the heating device according to changes of electrical resistance of the heating device.

34. The method of sealing an edge region of a planar material ply of claim 19, further comprising the step of displaying data indicating status information of the heating device.

* * * * *